United States Patent [19]

Oberstrass

[11] Patent Number: 4,481,762

[45] Date of Patent: Nov. 13, 1984

[54] CONTROL FOR YARN FALSE TWISTING APPARATUS

[75] Inventor: Detley Oberstrass, Tönisheide, Fed. Rep. of Germany

[73] Assignee: Barmag Barmer Maschinenfabrik AG, Remscheid, Fed. Rep. of Germany

[21] Appl. No.: 429,796

[22] Filed: Sep. 30, 1982

[30] Foreign Application Priority Data

Sep. 10, 1982 [DE] Fed. Rep. of Germany ..... 3233624

[51] Int. Cl.[3] ..... D02G 1/08; D01H 13/16

[52] U.S. Cl. ..... 57/80; 57/280; 57/340; 57/348

[58] Field of Search ..... 57/334–340, 57/348, 88, 279, 89, 280, 78, 80, 81

[56] References Cited

U.S. PATENT DOCUMENTS

| | | | |
|---|---|---|---|
| 3,911,661 | 10/1975 | Naylor | 57/280 X |
| 4,235,071 | 11/1980 | Dillon | 57/280 |
| 4,301,648 | 11/1981 | Adenheuer et al. | 57/280 |
| 4,325,213 | 4/1982 | Adenheuer | 57/280 |
| 4,370,852 | 2/1983 | Oberstrass et al. | 57/340 |

*Primary Examiner*—John Petrakes

*Attorney, Agent, or Firm*—Bell, Seltzer, Park & Gibson

[57] ABSTRACT

A yarn false twisting apparatus is disclosed which has a control system which is designed to insure that the machine operator will properly complete the yarn thread-up procedure, and which also effectively precludes damage to the twisting apparatus if the thread-up procedure is not properly completed. The twisting apparatus includes a pair of yarn twist imparting members having cooperating friction surfaces for engaging a running yarn, a drive whorl which is operatively connected to the twist imparting members, and a pivotally mounted control arm which is connected to the drive whorl and which is pivotable between an operative position wherein the whorl engages a drive belt, and an inoperative position wherein the whorl is disengaged from the drive belt. In its operative position, the control arm is spaced from the yarn path through the twisting apparatus, but when the arm is moved to the inoperative position, the arm deflects the yarn from its normal path to thereby alert the operator to the inoperative condition of the apparatus. Also, when the yarn is thus deflected by the arm, the yarn will be withdrawn from the twisting zone of the twist imparting members, to thereby effectively preclude the possibility of a running yarn moving between the friction surfaces of an inoperative apparatus.

13 Claims, 7 Drawing Figures

CONTROL FOR YARN FALSE TWISTING APPARATUS

The present invention relates to a yarn false twisting machine of the type disclosed in the U.S. Pat. No. to Kubler, No. Re.30,159, and more particularly, to a control system for the yarn twisting apparatus of such machine.

As illustrated for example in the above noted Kubler patent, a yarn false twist machine typically subjects each of a plurality of running yarns to simultaneous twisting, heat setting, cooling, and untwisting operations, which results in the twist being permanently set into the yarn. Each twisting apparatus of the machine commonly comprises twist imparting members having cooperating friction surfaces, such as a pair of rotating discs as described in U.S. Pat. No. 4,339,915, a pair of rotating belts as described in U.S. Pat. application Ser. No. 219,329, now U.S. Pat. No. 4,377,932, or three stacks of overlapping discs as described in U.S. Pat. Nos. 3,813,868 and 4,060,967.

A problem associated with the use of the known twist imparting members resides in the fact that the machine operator, after having threaded a yarn between the friction surfaces of the twist imparting members, sometimes forgets to bring the twisting apparatus into operation. As a result, the running yarn is not twisted, and in addition, the yarn tends to cut a groove in the stationary friction surfaces, resulting in their destruction.

It is accordingly an object of the present invention to provide a yarn false twisting apparatus which not only effectively alerts the operator to the inoperative condition of the apparatus, but also assures that the apparatus is brought into operation prior to the thread-up procedure.

It is a more particular object of the present invention to provide a control for a yarn false twisting apparatus wherein the false twisting apparatus must be set into operation to complete the thread-up procedure, to thereby avoid the possibility of having a running yarn moving between the opposed friction surfaces of an inoperative apparatus.

These and other objects and advantages of the present invention are achieved in the embodiment illustrated herein by the provision of a yarn false twisting apparatus which comprises a pair of twist imparting members having cooperating friction surfaces which define a twisting zone, yarn guide means for guiding a running yarn through the twisting zone of the twisting members and along a predetermined path on each side of the twisting zone, and drive means for operatively rotating each of the twist imparting members. The drive means includes a whorl mounted for movement in a direction perpendicular to its axis and between an operative position adapted to contact a tangential drive belt and an inoperative position withdrawn from the belt.

In accordance with the present invention, a control arm is operatively connected to the whorl of the drive means, with the arm being moveable between operative and inoperative positions which correspond to the operative and inoperative positions of the whorl. Also, the arm is positioned so as to lie in the predetermined yarn path when in its inoperative position, and to be spaced from the yarn path when in its operative position. Thus when the arm and whorl are in their inoperative positions, the arm will deflect the running yarn from the predetermined path to thereby alert the operator to the inoperative condition of the apparatus.

In the preferred embodiment, the yarn guide means of the apparatus includes a U-shaped open eyelet mounted on one side of the twist imparting members, and the arm is mounted adjacent the eyelet and the twist imparting members so as to deflect a running yarn from the eyelet and the twisting zone when the arm is in its inoperative position. Thus the running yarn will not run through the twisting zone when the arm and whorl are in their inoperative positions, and the possibility of having a running yarn moving through nonrotating twist imparting members is effectively precluded.

Also, in the preferred embodiment, one of the twist imparting members is readily flexible, and biasing means is mounted to the frame adjacent the flexible twist imparting member for biasing such member toward the other member at the twisting zone. In addition, there is provided a yarn sensor mounted along the predetermined yarn path so as to detect the presence of a running yarn in the predetermined yarn path. The movement of the arm to its inoperative position results in the yarn being withdrawn from the sensor. Preferably, the sensor is operatively connected to the biasing means to reduce the force of the biasing means upon the yarn being deflected from its predetermined path by the control arm being moved to its inoperative position. This reduction in the biasing force facilitates the subsequent thread-up of the yarn between the friction surfaces of the twist imparting members at the twisting zone.

Some of the objects having been stated, other objects and advantages of the present invention will become apparent as the description proceeds, when taken in connection with the accompanying drawings in which.

Figure 7:
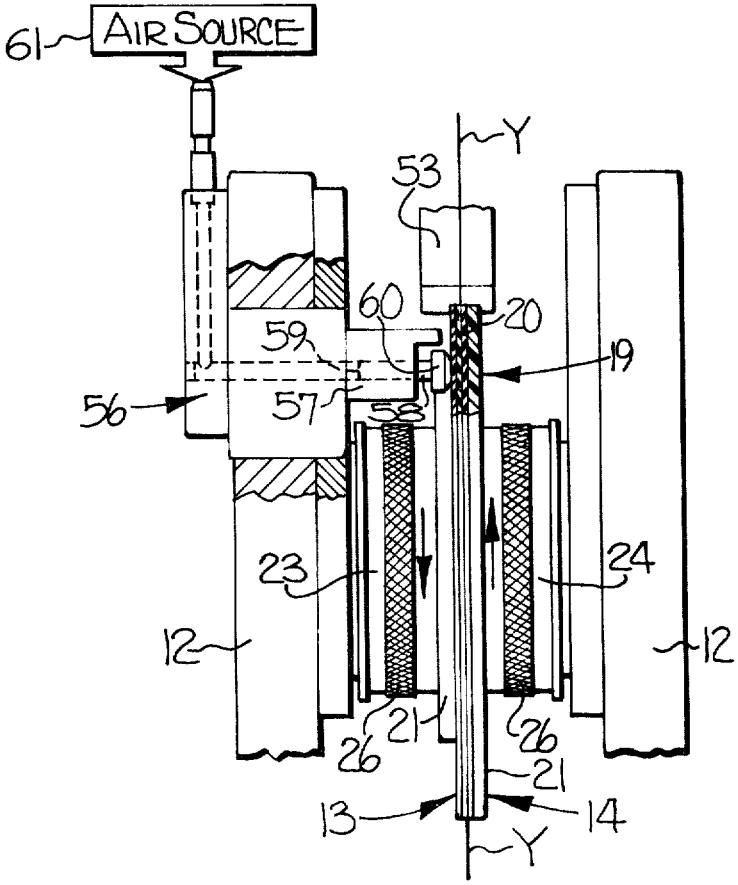
FIG. 7 is a fragmentary front elevation view of the twist imparting discs, and disc biasing member of the apparatus shown in FIG. 1.

Referring more particularly to the specific embodiment of the invention illustrated in the drawings, there is disclosed a yarn false twisting apparatus 10 which comprises a frame 12 which operatively mounts a pair of twist imparting members in the form of circular discs 13 and 14. The discs 13 and 14 are each relatively thin and flexible, and each includes a yarn engaging friction surface on one face thereof. The discs are rotatably mounted on generally parallel shafts 16 and 17, respectively, and such that the friction surfaces are disposed in opposing relationship and define a twisting zone at 19 (FIGS. 2 and 3) therebetween. As best seen in FIG. 7, a rigid circular back-up plate 20 is mounted on the shaft 17 and is disposed to overlie the full area of the opposite or outer side of the disc 14, and a back-up plate 21 of smaller diameter is mounted on the shaft 16 and disposed to overlie the opposite or outer side of the disc 13. The diameter of the plate 21 is such as to not overlie the twisting zone 19.

Figure 1:
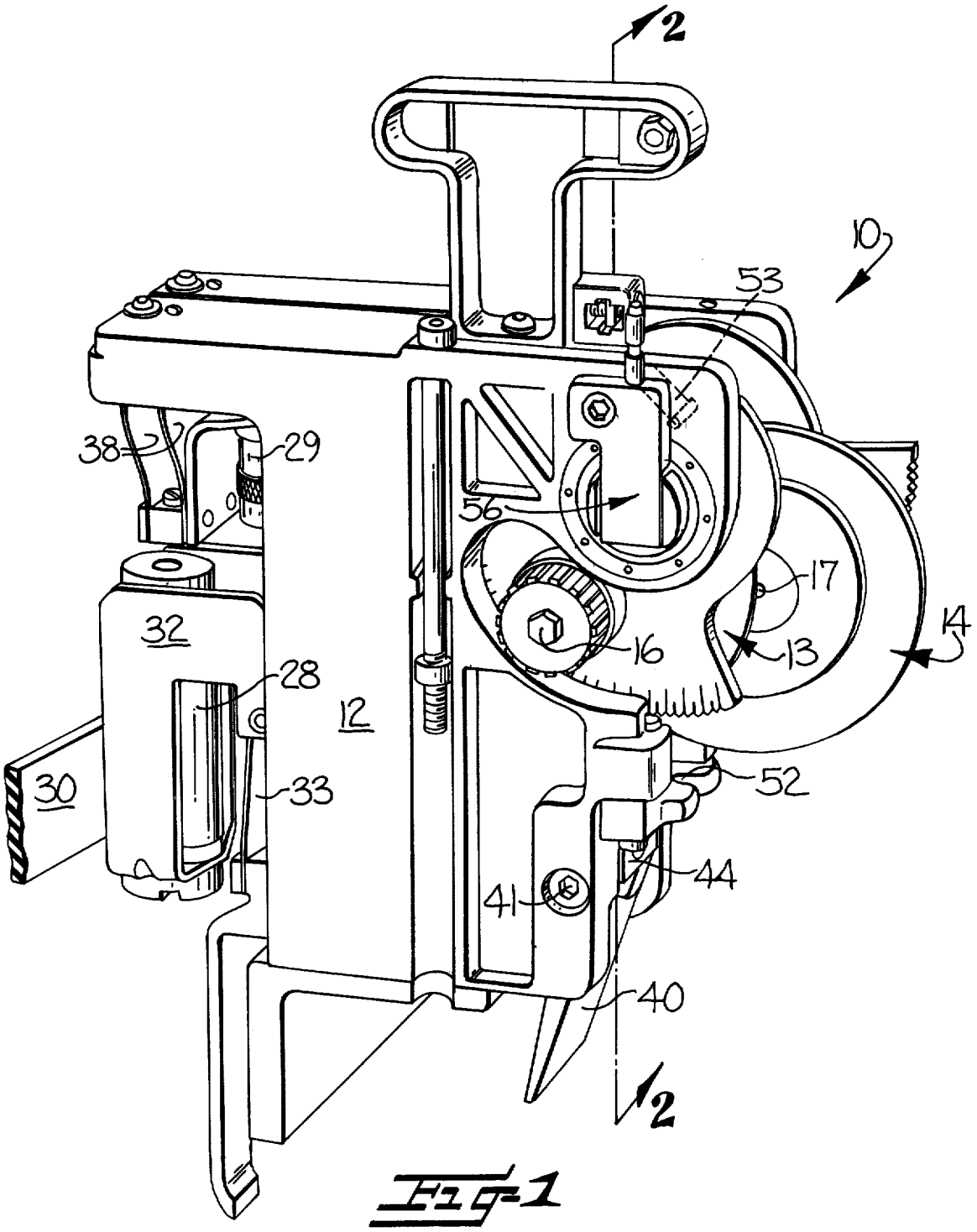
FIG. 1 is a perspective view of a yarn false twisting apparatus which embodys the features of the present invention.
Figure 2:
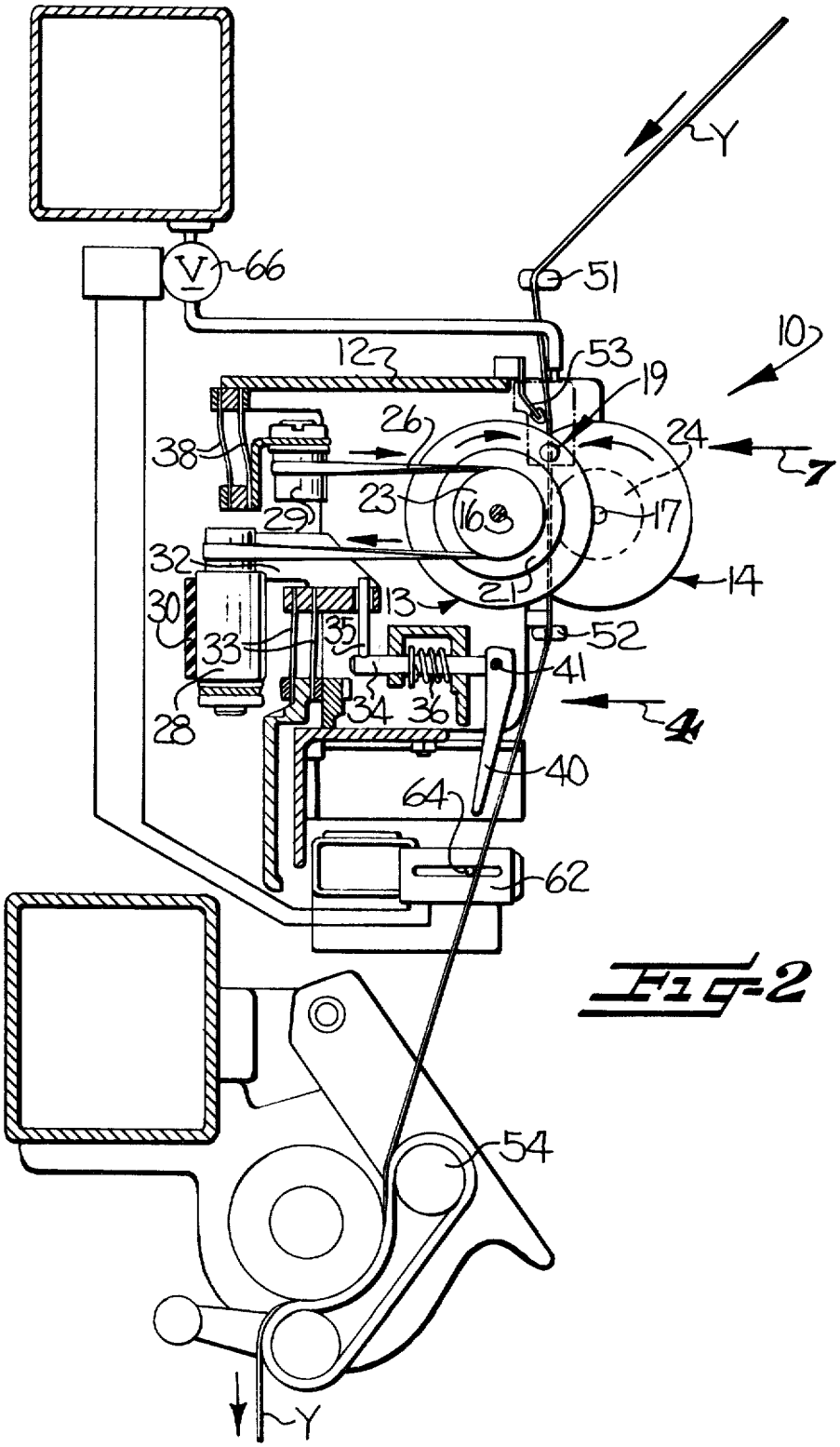
FIG. 2 is a sectional side elevation view of the apparatus, shown in its operative position, and taken substantially along the line 2—2 of FIG. 1.
Figure 3:
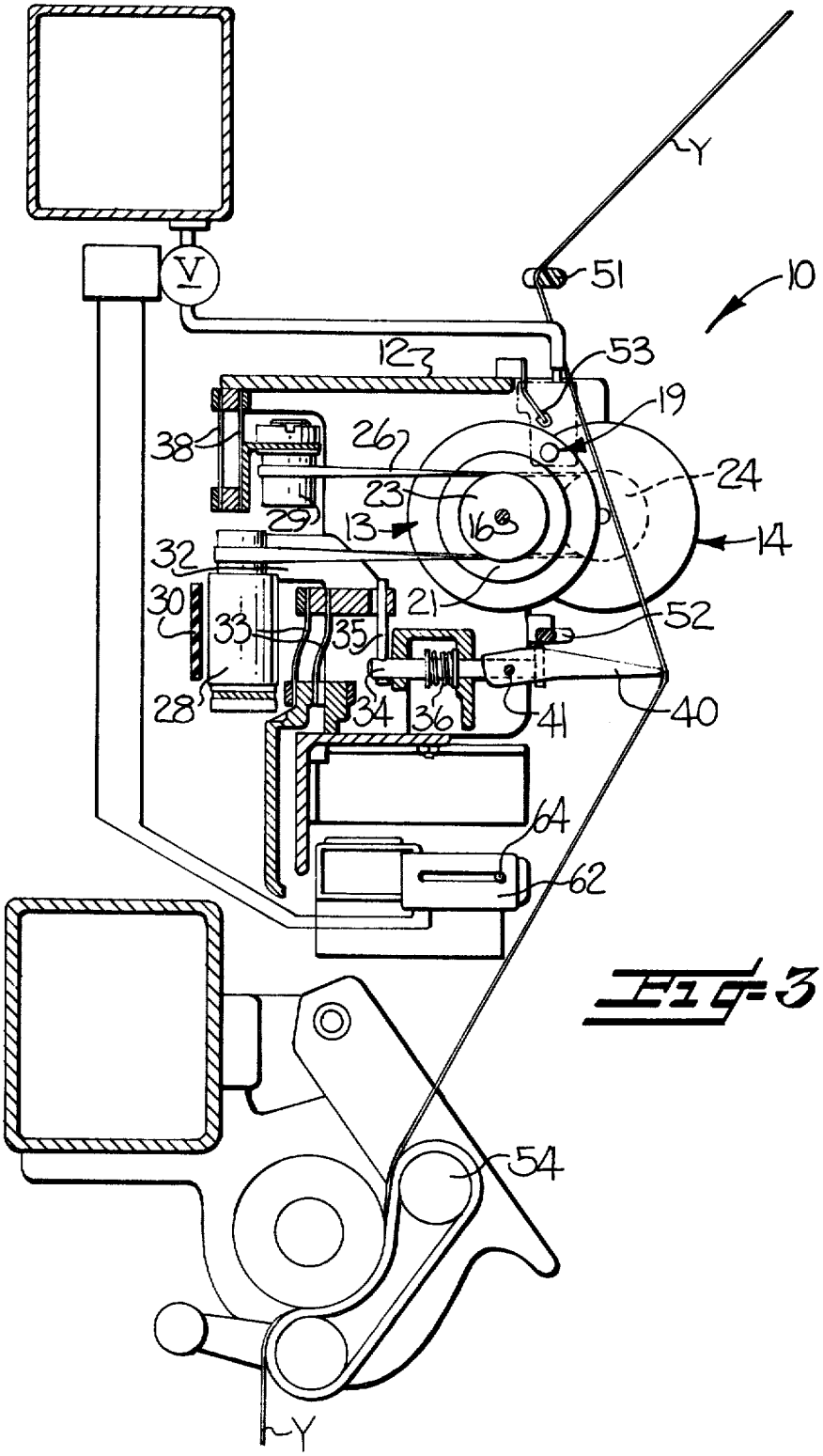
FIG. 3 is a view similar to FIG. 2, but illustrating the apparatus in its inoperative position.

The discs 13 and 14 are rotated by a drive system which includes a whorl 23, 24 coaxially mounted on the shafts 16, 17 respectively, and adjacent the outer face of each disc. A drive belt 26 loops around each whorl 23, 24, as well as about a main drive whorl 28, and a take-up whorl 29. The main whorl 28 is mounted for movement in a direction perpendicular to its axis and between an operative position adapted to contact the tangential drive belt 30 (as shown in FIGS. 1 and 2) and an inoperative position withdrawn from the belt 30 (as shown in FIG. 3). More particularly, the main whorl 28 is mounted to the frame 12 by an arrangement which includes a mounting bracket 32 which is connected to the frame by means of a parallel spring 33, and which permits movement of the whorl 28 between its operative and inoperative positions. A rod 34 is slideably mounted to the frame, and includes a pin 35 which extends through an aperture in the bracket 32, whereby axial movement of the rod 34 serves to correspondingly move the bracket 32, and thus the whorl 28. The rod 34 is biased by a spring 36 toward the left as seen in FIGS. 2 and 3, so as to normally bias the whorl 28 against the belt 30. The take-up whorl 29 is mounted to the frame 12 by means of a parallel spring 38, which is designed to accommodate the movement of the main whorl 28, while maintaining tension in the belt 26.

Figure 4:
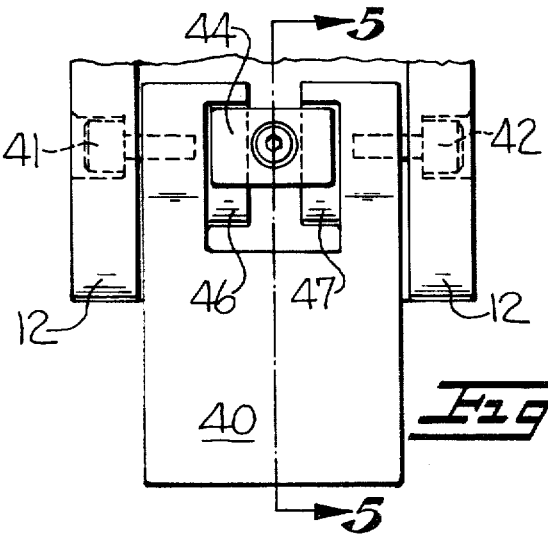
FIG. 4 is a fragmentary front elevation view of the control arm of the apparatus and taken along the direction of the arrow 4 in FIG. 2.
Figure 5:
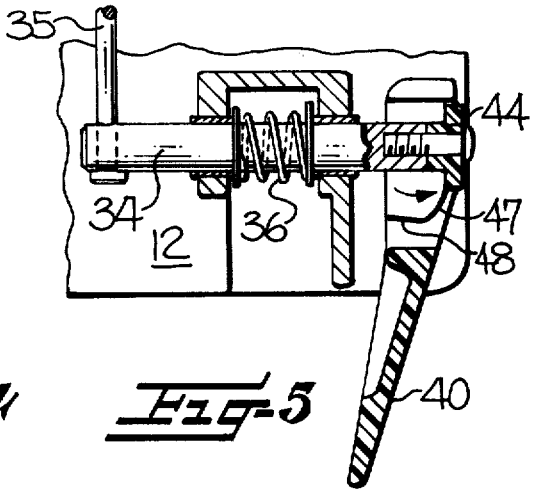
FIG. 5 is a sectional side elevation view of the control arm and taken substantially along the line 5—5 of FIG. 4.
Figure 6:
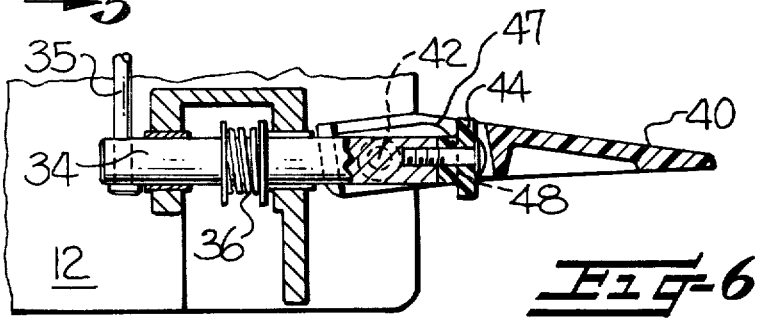
FIG. 6 is a view similar to FIG. 5 but illustrating the control arm pivoted to its inoperative position.

A control arm 40 is operatively connected to the rod 34, and thus the whorl 28, to permit the machine operator to selectively move the whorl between its operative and inoperative positions. As best seen in FIGS. 4–6, the arm 40 is pivotally mounted to the frame 12 by a pair of coaxial pins 41, 42. Also, the arm has the shape of a plate extending in the direction of the pivotal axis from one side to the other side of the yarn path. The rod 34 includes a rectangular head 44 at its forward end, and the arm includes a pair of integral cam surfaces 46, 47 positioned to contact the rear side of the head 44 on each side of the rod. The cam surfaces 46, 47 each terminate in a flat 48, which is disposed in a plane generally perpendicular to the lengthwise extent of the arm.

In the operative position of the apparatus, the arm 40 is disposed in the downward position as shown in FIGS. 1, 2, 4 and 5. To move the apparatus to its inoperative position, the arm 40 is lifted by the machine operator to the horizontal position shown in FIGS. 3 and 6. During this lifting operation, the arm is pivoted about the axis of the pins 41, 42 and the rod 34 will be drawn to the right by the engagement of the cam surfaces 46, 47 with the head 44, to thereby result in the whorl 28 being withdrawn from contact with the belt 30. In its final position as best seen in FIG. 6, the flats 48 engage the rear surface of the head 44 to maintain the horizontal position of the arm. To return the machine to its operative position, the operator presses downwardly on the arm 40 with sufficient force to overcome the contact between the flats 48 and the head 44 of the rod, and so that the arm pivots downwardly to its original position.

Yarn guide means are provided for guiding a running yarn Y through the twisting zone 19 and along a predetermined path on each side thereof. As best seen in FIGS. 2 and 3, the yarn guide means comprises a first U-shaped open eyelet 51 fixed on the frame upstream of the discs, and a second U-shaped open eyelet 52 fixed to the frame on the opposite side of the discs. The eyelet 51 opens toward the left as seen in the drawings, and the eyelet 52 opens in the opposite direction. A guide plate 53 is disposed immediately upstream of the discs and in alignment above the twisting zone. In addition, a conventional yarn delivery device 54 is disposed downstream of the apparatus.

As best seen in FIGS. 2 and 3, the arm 40 is mounted at a location immediately downstream of the eyelet 52, and such that in its inoperative position the arm acts to deflect a running yarn from the eyelet 52 and from the twisting zone 19. Thus a running yarn will be precluded from running through the twisting zone when the discs are not rotating. Also, it will be apparent that it is necessary to move the arm 40 to its operative position to complete the thread-up procedure, which renders it highly unlikely that the operator would fail to complete the procedure.

In the preferred illustrated embodiment of the apparatus, the disc 13 is readily flexible in a direction perpendicular to its friction surface and toward the disc 14. Also, the presence of the back-up plate 20 renders the disc 14 relatively rigid in resisting movement in such direction. In addition, there is provided a pressure applying member 56 for locally biasing the flexible disc 13 toward the other disc 14 at the twisting zone 19. As best seen in FIG. 7, the pressure applying member 56 comprises a receptacle 57 mounted on the side of the disc 13 opposite its friction surface and aligned with the twisting zone 19. A piston 58 is slideably mounted in the receptacle 57 and has a face 59 at one end which is disposed in the receptacle, and a free opposite end 60 which extends from the receptacle and is positioned to directly overlie the twisting zone 19. An air supply system 61 is provided for conveying pressurized air into the receptacle to act against the face 59 of the piston to bias the free end 60 thereof into operative contact with the adjacent surface of the disc 13, and thereby bias the disc 13 toward the other disc 14 at the twisting zone 19.

The illustrated embodiment of the present invention further comprises a yarn sensor 62 mounted to the frame along the predetermined yarn path at a point downstream of the eyelet 52 and the control arm 40. The sensor 62 includes a finger 64 which is positioned to be contacted by the yarn Y when the yarn is in its predetermined path, and which is free of contact with the yarn when the yarn is deflected by the arm 40 in its inoperative position. The sensor 62 is operatively connected to a valve 66 disposed in the air supply line for the biasing member 56, and such that the absence of a yarn moving along the yarn path will cause the finger 64 to move toward the right as seen in FIGS. 2 and 3, which results in the valve 66 opening to release the pressure of the pressure applying member 56.

To now describe the operation of the apparatus, it will be assumed that the apparatus is initially disposed in its operative position as seen in FIGS. 1 and 2. In this position, the whorl 28 is in engagement with the tangential drive belt 30, and the discs 13 and 14 are operatively rotated to impart twist to the running yarn Y. When it is desired to terminate operation of the apparatus, the arm 40 is lifted by the machine operator to the position shown in FIGS. 3 and 6. This lifting action causes the whorl 28 to withdraw from the drive belt 30 and rotation of the discs 12 and 13 will accordingly cease. Also, the sensor 62 will sense the absence of the yarn, and will actuate the valve 66 to substantially reduce the pressure of the air acting upon the piston of the pressure applying member 56. Upon return of the arm 40 to its original downward position, the running yarn will move between the discs at the twisting zone, and rotation of the discs will concurrently commence. Since the biasing force applied by the pressure applying member 56 is at a reduced level when the arm 40 is moved to its operative position, the yarn Y is able to readily move between the friction surfaces and into the twisting zone 19. Stated in other words, the yarn is able to move into the twisting zone before the sensor 62 senses the yarn at its predetermined path and actuates the valve 66 to apply full pressure. Thus yarn thread-up is facilitated.

In the drawings and specification, there has been set forth a preferred embodiment of the invention, and although specific terms are employed, they are used in a generic and descriptive sense only and not for purposes of limitation.

That which is claimed is:

1. A yarn false twisting apparatus comprising a frame, twist imparting members, each having yarn engaging friction surfaces, means mounting said members to said frame for rotational movement wherein portions of the respective yarn engaging friction surfaces define a twisting zone therebetween, yarn guide means for guiding a running yarn through said twisting zone and along a predetermined path on each side thereof, drive means for operatively rotating each of said twist imparting members and such that the running yarn has twist imparted thereto at said twisting zone, control means for setting said drive means into and out of operation, a control arm operatively connected to said control means and being moveable between an operative position and an inoperative position, and with the operative and inoperative positions of said arm corresponding respectively to the operative and inoperative setting of said control means, and with the arm lying in said predetermined yarn path when in its inoperative position and being spaced from said path in its operative position, whereby the arm will deflect the running yarn from said predetermined yarn path when the arm is in its inoperative position, to thereby alert the operator to the nonoperative condition of the apparatus and to block the yarn path.

2. The yarn false twisting apparatus as defined in claim 1 wherein said arm is mounted with respect to said guide means and said twist imparting members such that in its inoperative position the arm deflects a running yarn from said guide means and said twisting zone, and such that the running yarn will not run through the twisting zone when the twist imparting members are not rotating.

3. The yarn false twisting apparatus as defined in claim 1 or 2 further comprising yarn sensor means mounted to said frame and positioned along said predetermined yarn path, for generating an output signal depending from the presence of a yarn being disposed along said predetermined yarn path and such that the yarn being deflected from said path by the arm in its inoperative position does not operatively engage the yarn sensor means.

4. A yarn false twisting apparatus as defined in claim 1 wherein said drive means includes a whorl operatively interconnected to said twist imparting members, and means mounting said whorl for movement in a direction perpendicular to its axis and between an operative position adapted to contact a tangential drive belt and thereby impart rotation to said twist imparting members, and an inoperative position withdrawn from the belt and such that said twist imparting members are not rotated, and wherein said control arm is operatively connected to said means mounting the whorl, and with the operative and inoperative positions of said arm corresponding respectively to the operative and inoperative positions of said whorl.

5. The yarn false twisting apparatus as defined in claim 1 wherein said arm is pivotally mounted to said frame for movement about an axis extending generally perpendicular to said yarn path, and has the shape of a plate extending in the direction of the pivotal axis from one side to the other side of the yarn path, and such that in its operative position the arm is disposed generally parallel to the yarn path and in its inoperative position the arm is disposed generally perpendicular to the yarn path.

6. A yarn false twisting apparatus comprising a frame, a pair of twist imparting members, each having a generally flat yarn engaging friction surface, means mounting said members to said frame for rotational movement wherein portions of the respective yarn engaging friction surfaces are disposed in opposing relation and define a twisting zone therebetween, yarn guide means for guiding a running yarn through said twisting zone and along a predetermined path on each side thereof, drive means for operatively rotating each of said twist imparting members and such that the running yarn has twist imparted thereto at said twisting zone, said drive means including a whorl, belt means operatively interconnecting said whorl and said twist imparting members, and means mounting said whorl for movement in a direction perpendicular to its axis and between an operative position adapted to contact a tangential drive belt and thereby impart rotation to said twist imparting members, and an inoperative position withdrawn from the belt and such that said twist imparting members are not rotated, and a control arm operatively connected to said whorl and being moveable between an operative position and an inoperative position, and with the operative and inoperative positions of said arm corresponding respectively to the operative and inoperative positions of said whorl and with the arm lying in said predetermined yarn path when in its inoperative position and being spaced from said path in its operative position, whereby the arm will deflect the running yarn from said predetermined yarn path when the arm and whorl are in their inoperative positions, to thereby alert the operator to the nonoperative condition of the apparatus.

7. The yarn false twisting apparatus as defined in claim 6 wherein said yarn guide means includes a U-shaped open eyelet fixedly mounted on said frame at one side of said twist imparting members, and wherein said arm is mounted with respect to said eyelet and said twist imparting members such that in its inoperative position the arm deflects a running yarn from said eyelet and said twisting zone, and such that the running yarn will not run through the twisting zone when the twist imparting members are not rotating.

8. The yarn false twisting apparatus as defined in claim 6 or 7 further comprising yarn sensor means mounted to said frame and positioned along said predetermined yarn path, for generating an ouput signal upon the absence of a yarn being disposed along said predetermined yarn path and such that the output signal is generated upon the yarn being deflected from said path by the arm in its inoperative position.

9. The yarn false twisting apparatus as defined in claim 6 or 7 wherein said arm is pivotally mounted to said frame for movement about an axis extending generally perpendicular to said yarn path, and such that in its operative position the arm is disposed generally parallel to the yarn path and in its inoperative position the arm is disposed generally perpendicular to the yarn path.

10. A yarn false twisting apparatus comprising a frame, a pair of twist imparting members, each having a generally flat yarn engaging friction surface, and with at least one of the members being readily flexible in a direction perpendicular to its friction surface, means mounting said members to said frame for rotational movement wherein portions of the respective yarn engaging friction surfaces are disposed in opposing relationship and define a twisting zone therebetween, yarn guide means for guiding a running yarn through said twisting zone and along a predetermined path on each side thereof, drive means for operatively rotating each of said twist imparting members, and such that the running yarn has twist imparted thereto at said twisting zone, said drive means including a whorl, belt means operatively interconnecting said whorl and said twist imparting members, and means mounting said whorl for movement in a direction perpendicular to its axis and between an operative position adapted to contact the tangential drive belt and thereby impart rotation to said twist imparting members, and an inoperative position withdrawn from the belt and such that said twist imparting members are not rotated, biasing means operatively mounted to said frame adjacent said one flexible twist imparting member for biasing said one member toward the other member at said twisting zone, a control arm operatively connected to said whorl and being moveable between an operative position and an inoperative position, and with the operative and inoperative positions of said arm corresponding respectively to the operative and inoperative positions of said whorl, and with the arm lying in said predetermined yarn path when in its inoperative position and being spaced from said path in its operative position, and whereby the arm will deflect the running yarn from said predetermined yarn path when the arm and whorl are in their inoperative positions, and yarn sensor means mounted to said frame along said predetermined yarn path and being operatively associated with said biasing means for rendering the biasing means substantially inoperative upon the yarn being deflected from said predetermined path by said control arm in its inoperative position.

11. The apparatus as defined in claim 10 wherein said biasing means comprises a receptacle mounted on the side of said one twist imparting member opposite its yarn engaging friction surface and aligned with said twisting zone, a piston slideably mounted in said receptacle and having a face at one end and a free opposite end which is positioned to directly overlie said twisting zone, and fluid supply means for conveying a fluid under pressure into said receptacle to act against the face of said piston to bias the free end thereof into operative contact with the adjacent surface of said one member and thereby bias the same toward said other member at said twisting zone.

12. The apparatus as defined in claim 11 wherein said sensor means further comprises means for substantially reducing the pressure of said fluid supply means upon the yarn being deflected from its path of travel by the control arm being moved to its inoperative position, to reduce the biasing force of said piston and thereby facilitate the thread-up of said apparatus by limiting the nipping force applied to the yarn at said twisting zone.

13. The apparatus as defined in any one of claims 10–12 wherein said twist imparting members comprise circular discs mounted for rotation about generally parallel axes, with the disc which is acted upon by said biasing means being readily flexible at said twisting zone, and with the other of said discs being supported to resist deflection by the force of said biasing means at said twisting zone.

* * * * *